US008878745B2

(12) United States Patent
Navarre et al.

(10) Patent No.: US 8,878,745 B2
(45) Date of Patent: Nov. 4, 2014

(54) MOBILE-BEAM ANTENNA MOUNTING

(75) Inventors: Gilles Navarre, Toulouse (FR); Philippe Lepeltier, Castanet (FR); Pierre Bosshard, Tournefeuille (FR)

(73) Assignee: Thales, Neuilly sur Seine (FR)

( * ) Notice: Subject to any disclaimer, the term of this patent is extended or adjusted under 35 U.S.C. 154(b) by 164 days.

(21) Appl. No.: 13/505,434

(22) PCT Filed: Oct. 20, 2010

(86) PCT No.: PCT/EP2010/065778

§ 371 (c)(1),
(2), (4) Date: May 1, 2012

(87) PCT Pub. No.: WO2011/054669

PCT Pub. Date: May 12, 2011

(65) Prior Publication Data

US 2012/0212396 A1 Aug. 23, 2012

(30) Foreign Application Priority Data

Nov. 3, 2009 (FR) ..... 09 05262

(51) Int. Cl.
*H01Q 15/14* (2006.01)
*H01Q 3/20* (2006.01)
*H01Q 1/28* (2006.01)

(52) U.S. Cl.
CPC . *H01Q 3/20* (2013.01); *H01Q 1/288* (2013.01)
USPC ..... 343/912; 343/761; 343/839

(58) Field of Classification Search
None
See application file for complete search history.

(56) References Cited

U.S. PATENT DOCUMENTS

| | | | | |
|---|---|---|---|---|
| 3,680,144 | A * | 7/1972 | Low et al. | 343/781 R |
| 4,145,695 | A * | 3/1979 | Gans | 343/779 |
| 4,862,185 | A | 8/1989 | Andrews et al. | |
| 6,150,990 | A * | 11/2000 | Ramanujam et al. | 343/781 CA |
| 6,307,521 | B1 * | 10/2001 | Schindler et al. | 343/781 CA |
| 6,320,553 | B1 * | 11/2001 | Ergene | 343/781 P |
| 7,038,632 | B2 * | 5/2006 | Webb et al. | 343/781 P |
| 2003/0128169 | A1 * | 7/2003 | Desargant et al. | 343/781 P |
| 2003/0234746 | A1 * | 12/2003 | Tang et al. | 343/781 CA |
| 2004/0008148 | A1 * | 1/2004 | Lyerly et al. | 343/781 P |
| 2004/0125037 | A1 * | 7/2004 | Parsons et al. | 343/781 P |
| 2004/0257289 | A1 * | 12/2004 | Geen | 343/781 P |
| 2005/0110694 | A1 * | 5/2005 | Webb et al. | 343/781 P |

FOREIGN PATENT DOCUMENTS

| | | | |
|---|---|---|---|
| EP | 0139482 | A2 | 5/1985 |
| FR | 2651071 | A1 | 2/1991 |
| FR | 2677492 | A1 | 12/1992 |

* cited by examiner

*Primary Examiner* — Trinh Dinh
(74) *Attorney, Agent, or Firm* — Baker & Hostetler LLP

(57) ABSTRACT

A mobile-beam antenna mounting comprises a supporting base, at least one reflector and a transmission and/or reception feed. The feed is mounted in the mounting so as to be immobile relative to the supporting base and the mounting also comprises a mobile support bearing the reflector, the mobile support being mounted on the supporting base with link means suitable for displacing it about at least one fixed displacement axis passing through the phase center of the feed.

6 Claims, 3 Drawing Sheets

MOBILE-BEAM ANTENNA MOUNTING

CROSS REFERENCE TO RELATED APPLICATIONS

This application is a National Stage of International patent application PCT/EP20010/065778, filed on Oct. 20, 2010, which claims priority to foreign French patent application No. FR 0905262, filed on Nov. 3, 2009, the disclosures of which are incorporated by reference in their entirety.

FIELD OF THE INVENTION

The field of the invention relates to the mountings of mobile-beam antennas, notably the antennas on board telecommunication satellites.

BACKGROUND

Telecommunication satellites include antennas that can generate mobile beams for broadcasting multimedia services. These services require the communication networks to be able to cover wide geographic areas and maintain a sufficiently high signal quality over the entire area to be covered. For this, there are mobile-beam antennas that can modify the pointing direction of the beam in order to meet the needs of the telecommunication services.

The telecommunication satellites receive data from the ground stations then they transmit these data to the Earth by means of antennas positioned facing the Earth. Double-reflector passive antennas are preferentially used because they offer the best trade-off between the weight, bulk, efficiency and cost constraints. This is because these double-reflector antennas make it possible, with a given equivalent focal length, to reduce the bulk of the antenna in comparison to a single-reflector antenna. This offers a particularly interesting advantage for reducing the bulk of a satellite in a launch vehicle.

The known passive antenna solutions for displacing a beam of radiofrequency signals over the earth's surface are antennas comprising means that allow for the movement either of the complete antenna mounting or of only the reflector by changing the orientation of the reflecting surface. The existing passive antenna mounting solutions comprise a feed for transmitting and/or receiving RF signals, one or more reflectors and a supporting base to bear all the radiofrequency components of the antenna. There are a number of types of mounting, among which the mountings of Cassegrain type and of Gregorian antenna type can be named by way of indication.

Also known from the prior art is the patent document EP0139482. This document discloses a mobile-beam antenna in which only the reflectors are displaced. It relates to a fixed feed mounting in which the focal point of the primary reflector is maintained on the focus of the secondary reflector.

In the case of movement of the complete antenna mounting, that is to say the assembly consisting of the supporting base, the reflector(s) and the transmission and/or reception feed, the design of the link between the feed and the payload of the satellite becomes problematical. This is because it is necessary to use deformable waveguides or rotating joints which have the following drawbacks: radiofrequency signal losses, frequency band limitation, power limitations, mechanical limitation and numerous actuations and limitation on the numbers of ports at the antenna radiofrequency interface. Furthermore, the deformable waveguides generally have a stiffness that can be significant, resulting in additional stresses on the kinematic means of the antenna mounting. The latter in fact have to be dimensioned so as to be able to deform these mechanical parts.

These many drawbacks linked to the mobility of the feed can be resolved by an alternative antenna mounting solution for which only the orientation of the reflector is modified. However, in the case of a parabolic reflector, when its orientation is modified, the focus of the parabola is also offset from the phase center of the feed. This offset results in a distortion of the radiofrequency geometry leading to degraded efficiency through the focusing aberrations.

SUMMARY OF THE INVENTION

The invention overcomes the above-mentioned problems and proposes an antenna mounting that makes it possible to transmit and/or receive a mobile beam, comprising simplified kinematic mechanics and exhibiting better radiofrequency efficiency.

The invention further provides a mobile-beam antenna mounting comprising a supporting base, a parabolic primary reflector having a focus and a secondary reflector of ellipsoid type having two focuses, a feed for transmitting and/or receiving RF signals forming a beam mounted in the mounting so as to be immobile relative to the supporting base, a mobile support bearing the primary reflector and the secondary reflector, said reflectors being immobile relative to one another, the mobile support being mounted on the supporting base with link means suitable for displacing the reflectors about at least one fixed displacement axis passing through the phase center of the feed.

Advantageously, the focus of the primary reflector is kept positioned on a first focus of the secondary reflector and the second focus of the secondary reflector is kept positioned on the phase center of the feed in any position of the mobile support.

Thus, according to an essential feature, the mobile support, the primary reflector and the secondary reflector form a mobile assembly relative to the supporting base.

According to any one of the variants, the link means are suitable for moving said mobile assembly about two rotation axes convergent at the phase center of the feed.

According to any one of the variants, the surface area of at least one reflector is substantially greater than the surface area of the beam reflected on the surface of said reflector.

The antenna mounting according to the invention resolves the problems of connection between the RF feed and the payload of the satellite. Furthermore, the immobility of the feed in the mounting does not require the use of flexible waveguides and complex kinematic means for deforming this type of waveguide. It also results in better radiofrequency efficiency.

Furthermore, the displacement of the assembly consisting of the mobile support and the reflectors, mutually immobile, about the feed makes it possible to maintain the most optimal RF signal propagation geometry and to reduce, or even render nonexistent, the focusing aberrations of the antenna mounting. In the final analysis, the mounting allows for a displacement of the beam over the Earth without any deformation of the beam.

BRIEF DESCRIPTION OF THE DRAWINGS

The invention will be better understood and other advantages will become apparent from reading the following description, given as a nonlimiting example, and by virtue of the appended figures in which.

DETAILED DESCRIPTION

The antenna mounting according to the invention is particularly intended for space telecommunication applications. The telecommunication satellites generally have a parallelepipedal form including an Earth face permanently directed toward the Earth. An RF signal transmission system is mounted on this Earth face in order to accomplish the mission of the satellite such as, for example, the offering of a telephony and data and video transmission service. To meet the needs of these missions, it is known practice to use mobile antennas which make it possible to displace the beam of RF signals over the earth's surface.

Usually, these antennas comprise a paraboloidal reflector based on the geometric properties of the curve called parabola and of the surface called paraboloid of revolution. The parabolic reflector is responsible for concentrating the waves received or transmitted toward the antenna-feed, commonly called feed, which is situated at the focus of the parabola. A number of types of paraboloidal reflector antenna mountings can be used in the context of the invention. The antenna mountings comprising a single reflector and the mountings with several reflectors, commonly called Cassegrain antenna-type mounting or Gregorian antenna-type mounting, can be cited.

The object of the invention is described hereinbelow on the basis of the example of an antenna mounting that is particularly well suited for a space application. It is a mounting of Gregorian antenna type. However, the scope of the invention is not limited to this type of antenna mounting. Those skilled in the art know how to adapt the concept of the invention to the other types of antenna mounting comprising an ellipsoidal secondary reflector.

Figure 1:
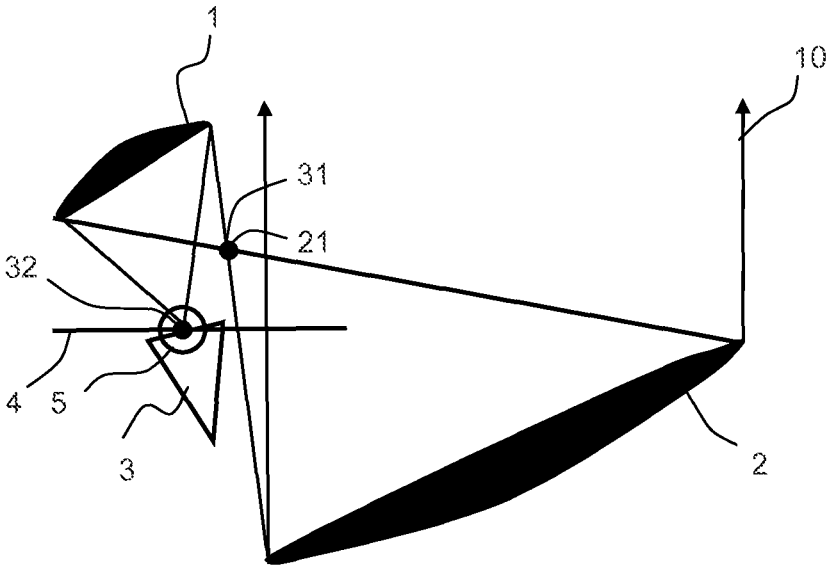
FIG. 1 represents a schematic diagram of the antenna mounting according to the invention symbolizing the feed, the primary reflector and the secondary reflector.

FIG. 1 represents a simplified diagram of the functional elements participating in the transmission and/or reception function of a mounting of Gregorian antenna type. The antenna comprises a primary reflector 2 and a secondary reflector 1. The primary reflector 2 has a paraboloidal form concentrating the RF signals toward the focus 21 of the parabola. The secondary reflector 1 has an ellipsoidal form. In a Gregorian antenna mounting, the feed is offset from the central axis of the secondary reflector 1. This type of mounting with an offset feed is a so-called "offset" mounting and has the advantage of not positioning the feed in the field of the radiofrequency beam, therefore avoiding a loss of efficiency. The use of a secondary reflector 1 of ellipsoidal form, making it possible to offset the feed, has two focuses, a primary focus 32 and a secondary focus 31. According to an essential feature of the invention, for a mounting of Gregorian antenna type, the primary reflector and the secondary reflector are mounted together in the antenna mounting in such a way that the secondary focus 31 of the secondary reflector is merged with the focus 21 of the primary reflector 2, regardless of the orientation of the beam 10.

The antenna comprises a feed 3 reflecting toward the secondary reflector 1. According to an essential feature of the invention, for a mounting of Gregorian antenna type, the feed is mounted in such a way that the primary focus 32 of the secondary reflector 1 is merged with the phase center of the feed 3, regardless of the orientation of the beam. According to an essential feature of the invention, the feed 3 is mounted immobile in the mounting of the antenna. The feed 3 is preferably fixed to the supporting base 6. Thus, the antenna mounting with an immobile feed makes it possible to avoid the use of deformable waveguides or rotating joints.

Figure 2:
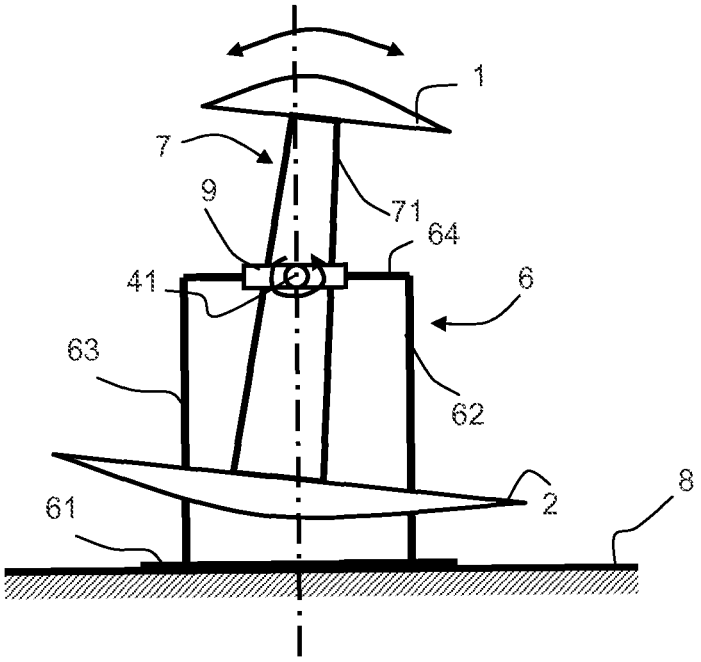
FIG. 2 represents a simplified diagram of the antenna mounting from a front view.
Figure 3:
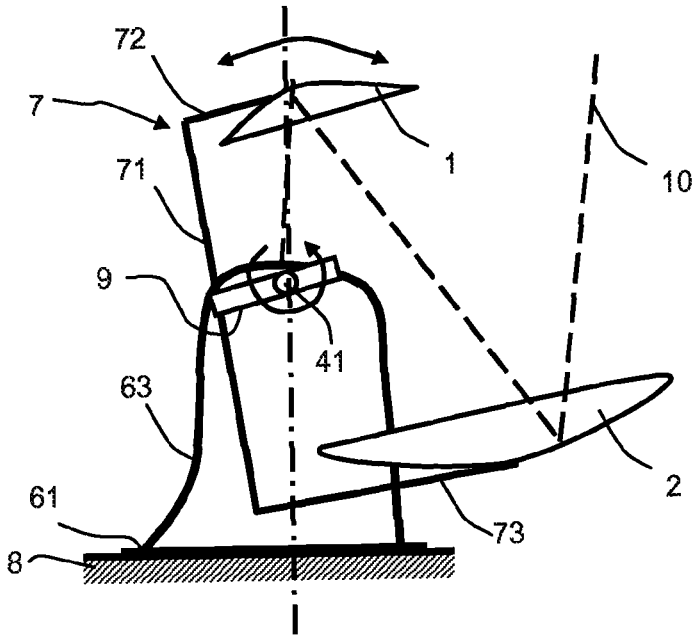
FIG. 3 represents a simplified diagram of the antenna mounting from a profile view.

The displacement of the beam of the antenna is then produced by making the primary reflector 2 and the secondary reflector 1 mobile relative to the feed 3. FIGS. 2 and 3 represent a simplified diagram of the antenna mounting of Gregorian antenna type according to the invention from a front view and a profile view. For the purposes of clarity of the drawings, the feed is not represented. The phase center of the feed is represented by the reference 41. The antenna mounting comprises a supporting base 6 and a mobile support 7.

The supporting base 6 is mounted on a coordinate system 8 so as to be immobile relative to this coordinate system. This coordinate system 8 represents, for example, the Earth face of a telecommunication satellite. The feed 3 is mounted in the antenna mounting so as to be also immobile relative to the coordinate system 8. Preferably, the feed 3 is fixed to the supporting base 6. As an example, the supporting base 6 comprises a bottom part 61 covering a sufficient surface area to stabilize all the mounting on the satellite. Two elongate lateral parts 62 and 63, fixed at a first end on the stabilization surface 61, extend opposite the satellite substantially perpendicular to the stabilization surface 61 symmetrically relative to this surface. The two lateral parts 62 and 63 are linked together at their second ends by a longitudinal part 64 also used to fix link means 9 between the supporting base 6 and the mobile support 7.

The mobile support 7 is articulated on the supporting base 6 with link means 9 so as to confer on the mobile support 7 a capability for mobility relative to the feed 3 and consequently relative to the coordinate system 8, the feed 3 in effect being immobile relative to the coordinate system 8. The mobile support 7 holds the primary reflector 1 and the secondary reflector 2. The two reflectors are immobile relative to one another on the mobile support 7, fixing means making it possible to hold the two reflectors on the mobile support.

According to an essential feature of the invention, the link means 9 make it possible to displace the mobile support 7 about at least one rotation axis 4 passing through the phase center 41 of the feed 3, and preferentially about two rotation axes 4 and 5 converging through the phase center 41 of the feed 3. The two rotation axes 4 and 5 are perpendicular to one another and make it possible to displace the reflectors about the feed 3, in a number of distinct positions in the mounting, according to the degrees of freedom necessary to the beam displacement requirement.

The propagation geometry of the RF signals transmitted by the feed 3 in the assembly consisting of the primary reflector 2 and the secondary reflector 1 is formed in such a way that the main focus 32 of the secondary reflector 1 is located on the phase center of the feed 3 and the secondary focus 31 of the secondary reflector 1 is merged with the focus 32 of the main reflector 2. Thus, regardless of the position of the mobile support 7, the two reflectors are immobile relative to one another and the main focus 32 of the secondary reflector 1 is constantly kept located on the phase center 41 of the feed 3. The geometric properties of the ellipsoidal form of the secondary reflector 1 also keep the secondary focus 31 at the same position regardless of the position of the secondary reflector about the rotation axis or axes 4 and 5 converging at the phase center 41 of the feed. By geometry, the focus of the main reflector 2 is also kept at the level of the secondary focus.

The link means 9 consist, for example, of a dial-type mechanical articulation piece. The dial is a mechanical articulation used to transmit one or two rotational movements between two shafts with converging axes 4 and 5. The dial is preferably positioned at the level of the feed 3, which is itself fixed to the part 64 of the supporting base 6, in such a way that the rotation axes of the dial converge at the position of the phase center 41 of the feed 3.

As a nonlimiting example, the mobile support 7 may be a substantially U-shaped mechanical structure, comprising an elongate central part 71 and two elongate lateral parts 72 and 73, at each of the ends of the central part 71, positioned perpendicular relative to the central part. One lateral part is substantially longer than the second lateral part. Furthermore, the lateral part 73 supporting the primary reflector 2, with a circumference greater than the secondary reflector 1, consists of a length greater than the length of the lateral part 72 supporting the secondary reflector 2. Fixing means which are not represented hold the reflectors 2 and 1 on the mobile support 7. The link means 9 link the central part 71 of the mobile support with the supporting base 6. The supporting base 6 is a mechanical structure dimensioned in such a way as to allow the mobility of the assembly consisting of the mobile support 7 and the reflectors 2 and 1. The feed 3 mounted on the supporting base 6 is linked to the electronic equipment of the payload of the satellite for example.

For a picture of the concept of the invention, the antenna mounting can be likened to a cradle in which the mobile support 7 is balanced between the elongate lateral parts 62 and 63 of the supporting base 6 which is stabilized on a coordinate system 8. Thus, the reflectors 1 and 2 are displaced about the feed 3.

Because of the immobility of the feed 3, there are many resulting advantages including the fact that the antenna mounting demonstrates an improvement in radiofrequency efficiency and a use in frequency bands for which deformable waveguides are not qualified or do not exist. The antenna mounting also demonstrates a better power resistance and no functional limitations associated with the fatigue strength of the deformable guides. Furthermore, simpler mechanisms can be used because the waveguides have lower resisting torques.

Figure 4:
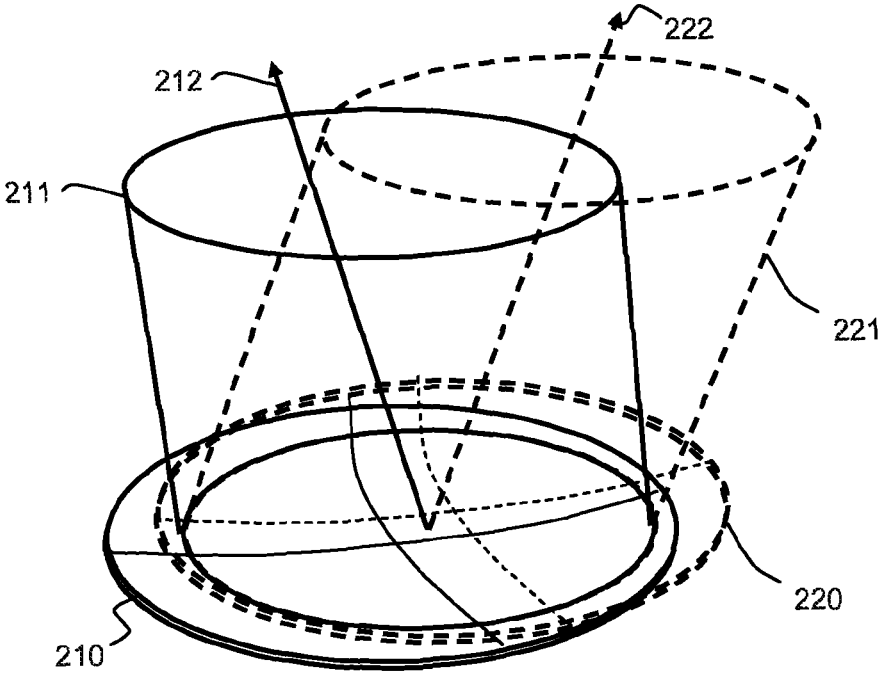
FIG. 4 represents a diagram of a reflector according to two positions as well as the reflected beam for each position.

FIG. 4 more specifically describes a reflector of the antenna mounting reflecting a beam according to two different positions. The reflector in a first position 210 reflects a beam 211 in a direction 212 and, in a second position 220, reflects a beam 221 in a direction 222. The reflected beams have a given diameter. According to a particular feature of the antenna mounting, the reflector has a diameter substantially greater than the diameter of the beam so that the surface area of the beam is constantly covered by the reflector regardless of the position of the reflector. In practice, since the feed is immobile, the surface of the beam is positioned at the same location in the mounting. The orientation of the beam is modified by displacement of the reflecting surface.

In the context of the invention, the term reflector should be understood to mean any type of surface exercising an RF beam reflection function, including the reflector arrays, commonly referred to as "reflect arrays". The reflector array is a periodic reflecting surface, consisting of metalized cells, placed above a ground plane. Detailed electromagnetic studies have made it possible to identify the optimum profile of these cells, so that they can reflect an incident wave with a parametrizable electrical delay. It is then possible to use a reflect array of canonical surface to produce the same radiation as that of a shaped reflector.

Figure 5A:
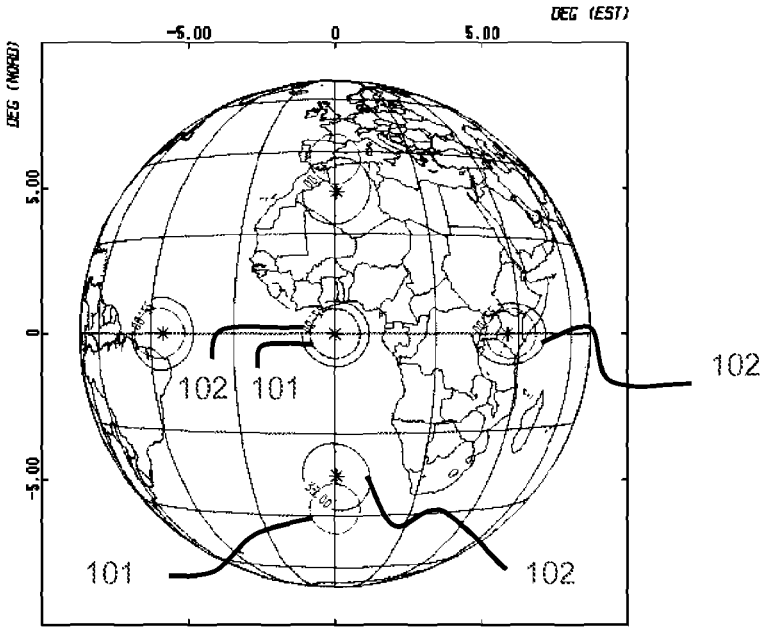
FIG. 5*a* represents radiofrequency simulations of transmission of mobile beams distributed over the earth's surface by means of an antenna mounting comprising a single mobile reflector.
Figure 5B:
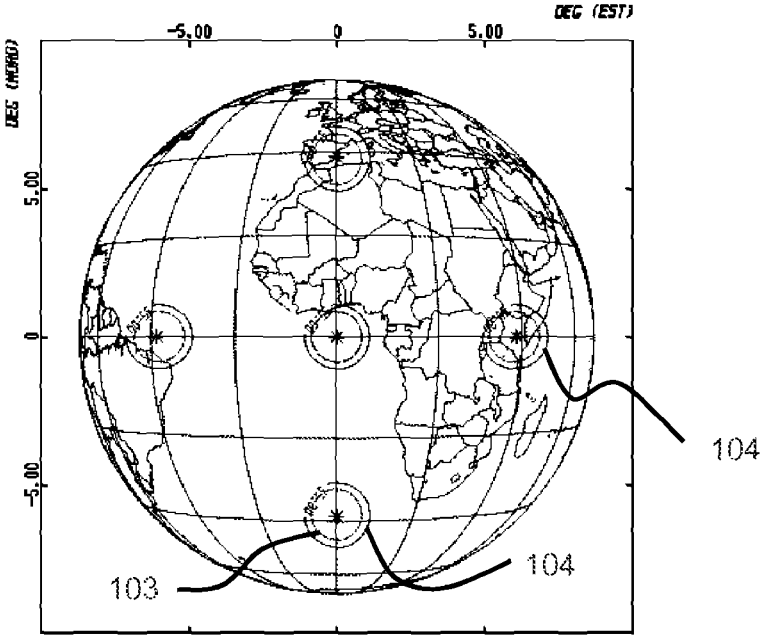
FIG. 5*b* represents radiofrequency simulations of transmission of mobile beams distributed over the earth's surface by means of an antenna mounting according to the invention.

FIGS. 5*a* and 5*b* represent simulations of transmission of a number of RF beams in a number of areas of the earth's surface. The simulations of FIG. 5*a* are produced with an antenna mounting as described in the prior art comprising a single mobile reflector. The antenna mounting points and displaces a beam 102 in a number of areas of the earth's surface. The circle 101 represents a circular surface targeted by the beam. The simulations show the deformation of the beam 102 in the east/west and north/south plane and the "displacement" of the beam 102 in the north/south plane of the beams. The simulations of FIG. 5*b* are produced with an antenna mounting according to the invention as claimed. The antenna mounting points and displaces a beam 103 in a number of areas of the earth's surface. The circle 103 represents a circular surface targeted by the beam. The simulations show the absence of deformation and of displacement of the beam 104.

The antenna mounting is applicable to antenna mountings for satellites with a feed that may or may not be offset and comprising at least two reflectors.

The invention claimed is:

1. A mobile-beam antenna mounting comprising: a supporting base, a parabolic primary reflector having a focus and a secondary reflector of ellipsoid type having two focuses, a feed for transmitting and/or receiving RF signals forming a beam mounted in the mounting so as to be immobile relative to the supporting base, a mobile support bearing the primary reflector and the secondary reflector, said reflectors being immobile relative to one another, the mobile support being mounted on the supporting base with link means suitable for displacing the reflectors about at least one fixed displacement axis passing through the phase center of the feed, wherein the focus of the primary reflector is kept positioned on a first focus of the secondary reflector and the second focus of the secondary reflector is kept positioned on the phase center of the feed in any position of the mobile support.

2. The antenna mounting as claimed in claim 1, wherein the mobile support, the primary reflector and the secondary reflector form a mobile assembly relative to the supporting base.

3. The antenna mounting as claimed in claim 2, wherein the link means are suitable for moving said mobile assembly about two rotation axes convergent at the phase center of the feed.

4. The antenna mounting as claimed in claim 3, wherein the surface area of at least one reflector is substantially greater than the surface area of the beam reflected on the surface of said reflector.

5. The antenna mounting as claimed in claim 2, wherein the surface area of at least one reflector is substantially greater than the surface area of the beam reflected on the surface of said reflector.

6. The antenna mounting as claimed in claim 1, wherein the surface area of at least one of the primary reflector and the secondary reflector is substantially greater than the surface area of the beam reflected on the surface of said reflector.

* * * * *